United States Patent [19]

Biller et al.

[11] 4,033,164

[45] July 5, 1977

[54] METHOD FOR ROLLING TUBES

[75] Inventors: Horst Biller, Kettwig; Friedrich Hüls, Mulheim, both of Germany

[73] Assignee: Mannesmannrohren-Werke AG, Dusseldorf, Germany

[22] Filed: Aug. 28, 1975

[21] Appl. No.: 608,671

[30] Foreign Application Priority Data

Aug. 29, 1974 Germany ..... 2441493

[52] U.S. Cl. ..... 72/205; 72/234; 72/367

[51] Int. Cl.[2] ..... B21B 17/00

[58] Field of Search ..... 72/205, 208, 209, 234, 72/235

[56] References Cited

UNITED STATES PATENTS 3,645,121 2/1972 Pfeiffer et al. ..... 72/205

*Primary Examiner*—Milton S. Mehr
*Attorney, Agent, or Firm*—Ralf H. Siegemund

[57] ABSTRACT

Tubular billets are stretch-rolled in that the rolls of locations closer to the entrance have the speeds reduced temporarily from their respective normal operation speed by an amount, which is made dependent upon the mean longitudinal tension in the billet during rolling.

4 Claims, No Drawings

METHOD FOR ROLLING TUBES

BACKGROUND OF THE INVENTION

The present invention relates to stretch-reducing tubular stock by rolling.

U.S. Pat. No. 3,645,121 of common assignee discloses a stretch-reducing rolling mill with a plurality of stand locations, wherein the speed of the rolls in the first m locations are lowered prior to entry of the stock to be rolled as compared with the speed during rolling, whereby the relative speed reduction is highest at the first stand and the smaller the farther a stand location is removed from the entrance to the train of rolls. As the tubular stock enters, the speed of the rolls in the individual locations is increased to normal operating speed dependent on the passing of the front section of the stock through several of the stands. The purpose of this procedure is to shorten the length of the front section that remains thicker than the remainder of the rolled stock. The above identified patent gives further details as to the changes in rotational speed of the rolls in the several locations

DESCRIPTION OF THE INVENTION

It is an object of the present invention to improve the known method of stretch rolling and to particularly avoid exceeding the lower tolerance limit as to wall thickness of the rolled tube.

In accordance with the preferred embodiment of the invention, it is suggested to reduce the speed of rolls in a stand of a stretch rolling mill in proportion to the mean longitudinal tension.

In practicing the invention, it is specifically suggested to consider a pattern for controlling the speed of the rolls in the several locations as set forth in the above-identified patent. Specifically, the front or first roll (as facing the oncoming tubular billet) is driven at a speed reduction of 50 % over its normal operational speed as per the known method; the other rolls have a smaller relative speed reduction at least immediately prior to and subsequently to engaging the billet. The maximum speed reduction, as per the invention, is to be 50 % multiplied by a factor F which is given by $$F = X_1 m/0.7 \cdot A + B$$

wherein $X_{1m}$ is the mean longitudinal tension and $A$ and $B$ are emperical factors; $A$ is a number from the range from 0.8 to 1.2 and $B$ is a number from 0 to 0.3. The mean longitudinal tension is calculated on the basis of the outer diameter and the wall thickness of the unrolled stock, and the outer diameter and wall thickness of the unrolled stock, and the outer diameter and wall thickness of the rolled tube. The percentage speed reductions of the other rolls follow the same pattern, but are modified accordingly, i.e. by the same factor F. Following passage of the front sections of the billet, the speeds are restored in steps in that the percentage reductions of rolls more to the front are equalized in steps with the reduction of rolls in locations further into the mill until all rolls have their normal speeds as needed for the stretch rolling, particularly of the middle portion of the billet. The rear section of the billet may be treated analogously.

By operation of the invention the speed modifications as per the principal method are modified to be lower with a lower mean longitudinal tension, so that the wall tube thickness remains within the tolerance particularly immediately ahead and behind the thickened tube ends. By way of example, the rolls of the first stand location may have a speed reduced by 0.5 F from normal operating speed for these rolls. The second set of rolls (in the next location) have a speed which is reduced from their normal speed by 0.45 · F only; the third location rolls have their speed reduced by 0.4 · F, etc.

After the front portion of the tubular billet has entered the first several rolls, the speed of the first one is raised to be reduced from its normal value by 0.45 · F only, i.e. by the same percentage amount as the speed reduction for the second location rolls. The speeds of the rolls for these two locations remain the same for a travel path length of about one location-to-location spacing. Thereafter, the speed of the first and second location rolls is raised to be reduced by only 0.4 · F, etc.

The speed changes follow in steps commensurate with the propagation of the billet by the distance between two locations in each instance in that the percentage speed reductions are gradually equalized until all rolls have their respective normal operating speed by which time the front section has passed all roll locations whose speeds were reduced for the stated reason.

It can thus be seen that the invention can be practiced by using a speed reduction pattern as shown in the above-identified patent, but modified as to each percentage by the above-defined factor F, in which the salient parameter is mean longitudinal tension. For rolling, e.g. a differently sized billet, but e.g. to obtain the same kind of tube, the mill is adjusted as is necessary generally for rolling a different billet, but in addition the speed reduction pattern is modified as per the now different factor F.

The invention is not limited to the embodiments described above, but all changes and modifications thereof not constituting departures from the spirit and scope of the invention are intended to be included.

We claim:

1. In a method of stretch-rolling tubular stock by means of a mill having a plurality of consecutively effective rolling locations and wherein the rolling speed in each location is reduced at least for the instant of engagement followed by raising of the speed, whereby the rolling speed of locations engaging the stock to be rolled earlier is reduced more than the speed of locations engaging the stock subsequently, and wherein normal operating speed of the rolls of the locations of the plurality is restored in steps and in dependence upon consecutive passage of the front of the stock through several of said locations, the improvement of causing the speed reductions to be proportional to the mean longitudinal tension in the stock during rolling.

2. Method as in claim 1, wherein the maximum speed reduction is 50 % multiplied by a factor F, wherein $$F = X_{1m}/0.7 \cdot A + B$$

and $X_{1m}$ is the mean longitudinal tension; $A$ is a number from 0.8 to 1.2 and B is a number between 0 and 0.3.

3. In a method of rolling down tubular material in a rolling mill, in which the rolls of consecutive stands normally operate gradually increasing rotational speed and which includes a stepwise reduction of the rotational roll speeds at a plurality of roll stands prior to entry of the front section of the tubular material, the percentage of the rotational speed reduction being at a maximum at the first stand location and decreasing at the subsequent stands, and which further includes subsequently, upon entry of the front section of the tubular material into the rolling mill, an increase in speed of the individual stand locations, dependent on the passing of such front section through a plurality of stand locations to the rotational speed sequence for a filled rolling mill, the improvement of reducing the speed in proportion to the mean longitudinal tension, so that the normally thickened front section of the tubular material is substantially shortened and the tolerance for minimum wall thickness of the tubular material is not exceeded.

4. Method as in claim 3, wherein the maximum speed reduction is 50 % multiplied by a factor F, wherein $$F = X_{1m}/0.7 \cdot A + B$$

and $X_{1m}$ is the mean longitudinal tension; $A$ is a number from 0.8 to 1.2 and $B$ is a number between 0 and 0.3.

* * * * *